US005169301A

United States Patent [19]

Donnelly et al.

[11] Patent Number: 5,169,301

[45] Date of Patent: Dec. 8, 1992

[54] CONTROL SYSTEM FOR GAS FIRED HEATING APPARATUS USING RADIANT HEAT SENSE

[75] Inventors: Donald E. Donnelly, Madison County, Ill.; John S. Haefner, Jefferson County; David J. Heritage, St. Louis, both of Mo.

[73] Assignee: Emerson Electric Co., St. Louis, Mo.

[21] Appl. No.: 877,722

[22] Filed: May 4, 1992

[51] Int. Cl.[5] ..... F23N 3/00

[52] U.S. Cl. ..... 431/20; 431/67; 126/116 A

[58] Field of Search ..... 431/20, 67; 126/116 A, 126/110 E

[56] References Cited

U.S. PATENT DOCUMENTS

| | | | |
|---|---|---|---|
| 3,589,846 | 6/1971 | Place et al. | 431/29 |
| 4,403,942 | 9/1983 | Copenhaver | 431/24 |
| 4,421,268 | 12/1983 | Bassett et al. | 431/20 |
| 4,898,229 | 2/1990 | Brown et al. | 165/11.1 |
| 4,925,386 | 5/1990 | Donnelly et al. | 431/28 |
| 5,020,988 | 6/1991 | Peterson | 431/51 |
| 5,022,460 | 6/1991 | Brown | 165/12 |
| 5,027,789 | 7/1991 | Lynch | 431/20 |

*Primary Examiner*—Carroll B. Dority
*Attorney, Agent, or Firm*—Paul A. Becker, Sr.

[57] ABSTRACT

A control system for a gas fired, direct ignition, induced draft furnace includes a radiant heat sensing switch responsive to a hot surface igniter and burner flame, a single-pole, double-throw pressure switch responsive to fluid flow effected by the inducer, and a plurality of relays responsive to the radiant heat sensing switch, the pressure switch, and various other connected switching means.

11 Claims, 1 Drawing Sheet

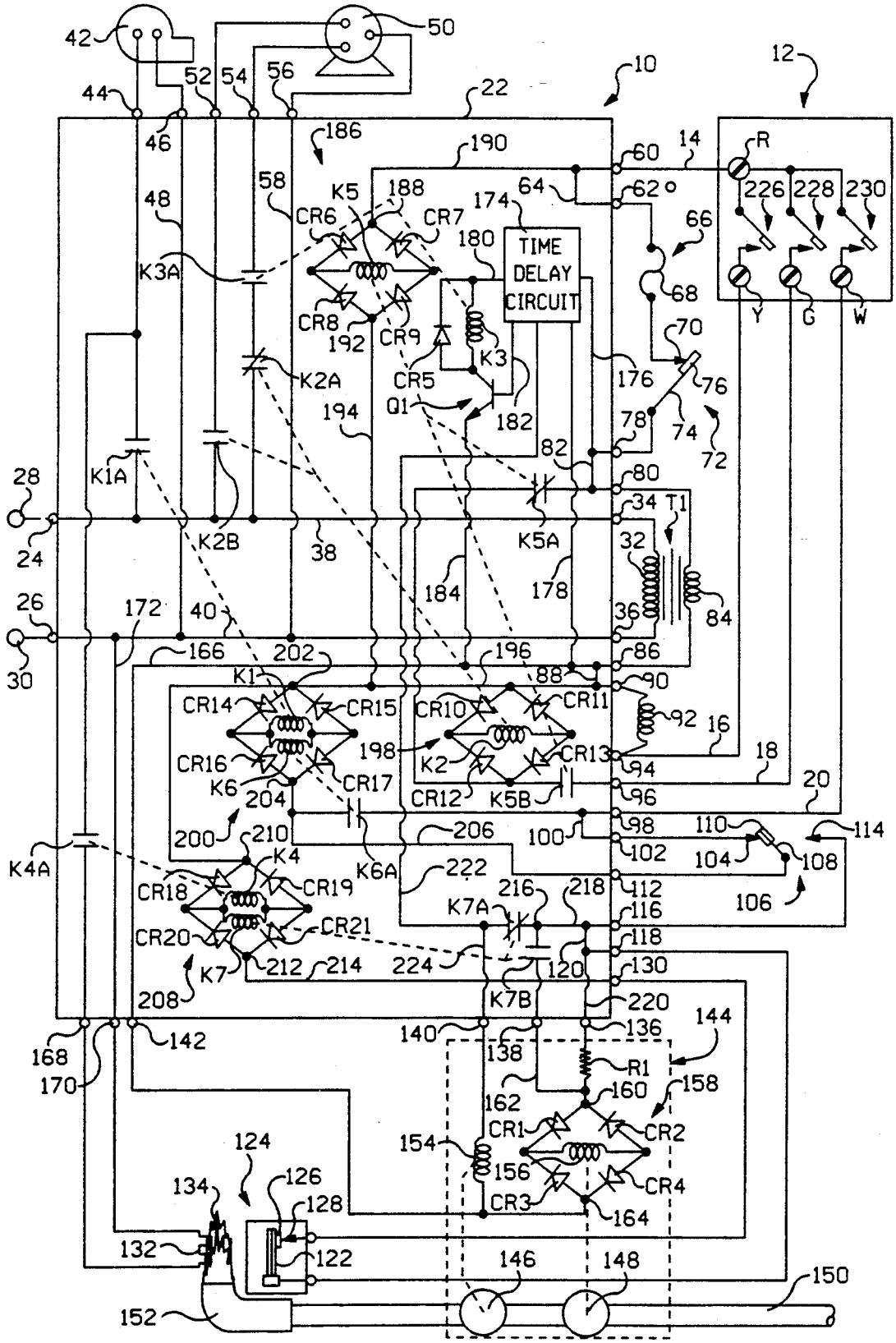
TIME DELAY CIRCUIT
R
Y
G
W
T1
K1
K2
K3
K4
K5
K6
K7
K1A
K2A
K2B
K3A
K4A
K5A
K5B
K6A
K7A
K7B
Q1
R1
CR1
CR2
CR3
CR4
CR5
CR6
CR7
CR8
CR9
CR10
CR11
CR12
CR13
CR14
CR15
CR16
CR17
CR18
CR19
CR20
CR21

CONTROL SYSTEM FOR GAS FIRED HEATING APPARATUS USING RADIANT HEAT SENSE

BACKGROUND OF THE INVENTION

This invention relates to electrically operated control systems for controlling operation of gas fired, induced draft heating apparatus in which a main burner is directly ignited by a hot surface igniter.

Due to the ever present need to conserve energy, many improvements have been made in recent years in the construction and operation of gas fired furnaces utilized in residential dwellings. A particularly popular construction is of a type which utilizes direct ignition of the main burner by a hot surface igniter whereby the conventional standing pilot is omitted. Some of such direct ignition furnaces further include the feature of induced draft wherein an inducer pulls in the air required for combustion and forces out, through the flue, the products of combustion.

In some of such direct ignition, induced draft furnaces, the combustion chamber and/or the flue are so constructed as to enable the furnace to operate at a relatively high rate of efficiency. For example, the combustion chamber and/or flue in such furnaces often includes tortuous paths effective for enabling highly efficient transfer of the heat generated by the burner flame to usable heated air for heating the dwelling. Because of such combustion chamber and/or flue construction, the quantity of fluid flow which can be effected by the inducer is inherently limited. While limited, the quantity of fluid flow must be adequate to provide safe operation of the system. The prior art discloses a variety of control systems for controlling operation of such high efficiency furnaces. Examples of such systems are shown in U.S. Pat. Nos. 4,925,386 and 5,022,460.

In some direct ignition, induced draft furnaces, the combustion chamber and/or flue are not as restrictive to fluid flow effected by the inducer as the high efficiency furnaces described in the preceding paragraph. While such furnaces do not provide the same high efficiency, they provide an efficiency higher than those furnaces utilizing the conventional standing pilot. Also, they are considerably less expensive than the high efficiency furnaces. While the control systems referenced in the preceding paragraph can be utilized in such less efficient furnaces, such control systems are relatively expensive to manufacture and provide features, such as precise time periods, not required in the less efficient furnaces. For example, in such less efficient furnaces, the quantity of fluid flow effected by the inducer is not as limited as in the high efficiency furnaces. Therefor, the less efficient furnaces can safely tolerate longer and less precise time periods wherein gas may be flowing and no flame exists. It would be desirable to provide a control system that would provide the control functions required in such less efficient, direct ignition, induced draft furnaces at a considerably less cost to manufacture than the prior art systems.

SUMMARY OF THE INVENTION

It is, therefore, an object of this invention to provide a generally new and improved control system for controlling operation of a gas fired, direct ignition, induced draft heating apparatus which is relatively inexpensive to manufacture.

A further object of this invention is to provide such a control system including a radiant heat sensing switch responsive to a hot surface igniter and burner flame, a single-pole, double-throw pressure switch responsive to fluid flow effected by the inducer, and a plurality of relays responsive to the radiant heat sensing switch, the pressure switch, and various other connected switching means so as to provide safe and reliable system operation.

In accordance with a preferred embodiment of the present invention, there is provided a control system for a gas fired heating apparatus adapted to be connected to a thermostat, which apparatus includes an inducer, a two-speed circulator fan, a main burner, two gas valves connected fluidically in series with the main burner, a hot surface igniter for directly igniting gas at the main burner, a high-limit switch, and a rollout switch. The control system includes a radiant heat sensing switch located in close proximity to the igniter and the main burner. The sensing switch has normally-closed contacts which open in response to the igniter being at a temperature above gas ignition temperature and which are maintained open thereafter in response to burner flame. The control system further includes a single-pole, double-throw pressure switch responsive to fluid flow effected by the inducer. When such fluid flow is absent, the pressure switch is in a first contact position; when such fluid flow exists, the pressure switch is in a second contact position. The control system further includes a plurality of relays, some of which are in circuit with the pressure switch when it is in its first contact position for effecting energizing of the inducer and for effecting energizing of a hold-in circuit which maintains energizing of the inducer when the pressure switch switches to its second contact position; some of which are in circuit with the hold-in circuit, the pressure switch when it is in its second contact position, and the radiant heat sensing switch, for controlling energizing of the igniter, operation of the gas valves, and, under further control by a time-delay circuit, for controlling the low speed winding of the fan; some of which provide for continuous operation of the fan at high speed based on a demand from the thermostat for continuous fan operation; and some of which provide for energizing of the fan at high speed in the event the high-limit switch or rollout switch opens.

The above-mentioned and other objects and features of the present invention will become apparent from the following description when read in conjunction with the accompanying drawing.

BRIEF DESCRIPTION OF THE DRAWING

The single FIGURE of the drawing is a schematic illustration of a control system constructed in accordance with the present invention.

DESCRIPTION OF THE PREFERRED EMBODIMENT

Referring to the drawing, shown generally at 10 is a heating and cooling apparatus, and shown generally at 12 is a room thermostat. Apparatus 10 is connected to thermostat 12 by leads 14, 16, 18 and 20. Apparatus 10 includes a control module 22 having a plurality of terminals to which leads 14, 16, 18 and 20 and various apparatus components are connected.

Control module 22 is connected at terminals 24 and 26 to terminals 28 and 30 of a conventional 120 volt alternating current power source. The primary winding 32 of a voltage step-down transformer T1 is connected to control module 22 at terminals 34 and 36. Terminal 34 is connected to terminal 24 by a lead 38, and terminal 36 is connected to terminal 26 by a lead 40.

An inducer 42, sometimes also referred to as a purge fan or combustion air blower, is connected to terminals 44 and 46 of control module 22. Terminal 44 is connected to lead 38 through a set of normally-open relay contacts K1A. Relay contacts K1A are controlled by relay coil K1. Terminal 46 is connected by a lead 48 to lead 40. Inducer 42 is in fluid-flow communication with the combustion chamber of a furnace (not shown). When gas is flowing into the combustion chamber, inducer 42 draws into the combustion chamber the air required for producing a combustible air-gas mixture, and provides a positive means for extracting the products of combustion and any unburned air-gas mixture out of the combustion chamber through the flue.

A circulator fan 50, sometimes referred to as a blower, is connected to terminals 52, 54 and 56 of control module 22. Terminal 52 is connected to lead 38 through a set of normally-open relay contacts K2B. Terminal 54 is connected to lead 38 through a series connection of a set of normally-open relay contacts K3A and a set of normally-closed relay contacts K2A. Relay contacts K2A and K2B are controlled by a relay coil K2; relay contacts K3A are controlled by a relay coil K3. Terminal 56 is connected by a lead 58 to lead 40. Fan 50 provides for the circulation or distribution of conditioned air throughout the dwelling. Fan 50 is a two-speed fan. When relay contacts K2B are closed, fan 50 runs at a relatively high speed; when relay contacts K2A and K3A are closed, fan 50 runs at a relatively low speed.

Lead 14 from a terminal R of thermostat 12 is connected to a terminal 60 of control module 22. A terminal 62 of control module 22 is internally connected by a lead 64 to terminal 60 and externally connected to one side of a normally-closed rollout switch 66. Switch 66 includes a thermally-responsive element 68. The other side of switch 66 is connected to the fixed contact 70 of a normally-closed high-limit switch 72. A movable switch arm 74 of high-limit switch 72 carries a contact 76 and is connected to a terminal 78 of control module 22. Rollout switch 66 is located in the vestibule portion of the furnace (not shown), and is effective to open its element 68 if it is impinged by flame. High-limit switch 72 includes a temperature sensing element (not shown) located in the plenum of the furnace, and is effective to open its contacts 70 and 76 if the temperature in the plenum reaches a value beyond which the furnace is designed to operate safely.

A terminal 80 of control module 22 is internally connected by a lead 82 to terminal 78 and externally connected to one side of the secondary winding 84 of transformer T1. The other side of secondary winding 84 is connected to a terminal 86 of control module 22. Terminal 86 is internally connected by a lead 88 to a terminal 90.

A compressor contactor coil 92, for effecting energizing of a compressor (not shown) in the cooling apparatus, is connected between terminal 90 and a terminal 94 of control module 22. Lead 16 is connected between terminal 94 and a terminal Y of thermostat 12. A terminal 96 of control module 22 is connected to a terminal G of thermostat 12 by lead 18. A terminal 98 of control module 22 is connected to a terminal W of thermostat 12 by lead 20.

Terminal 98 of control module 22 is internally connected by a lead 100 to a terminal 102. Terminal 102 is externally connected to a first fixed contact 104 of a single-pole, double-throw pressure switch 106. The movable arm 108 of pressure switch 106 carries a contact 110 and is connected to a terminal 112 of control module 22. A second fixed contact 114 in pressure switch 106 is connected to a terminal 116 of control module 22. Pressure switch 106 includes a pressure sensitive element (not shown) so located in the furnace as to be responsive to fluid flow effected by inducer 42. Specifically, when inducer 42 is running, the resultant fluid flow causes movable arm 108 to move so that contact 110 makes contact with fixed contact 114. When inducer 42 is not running, or when the rate of fluid flow is below a predetermined rate, movable arm 108 is in the position wherein contact 110 is in contact with fixed contact 104.

A terminal 118 of control module 22 is internally connected by a lead 120 to terminal 116 and externally connected to a bimetallic movable arm 122 of a radiant heat sensing switch 124. Movable arm 122 carries a contact 126. A fixed contact 128 of switch 124 is connected to a terminal 130 of control module 22. Switch 124, preferably Model 10RS manufactured by Therm-0-Disc Division, Emerson Electric Co., is responsive to radiant heat emitted by a hot surface igniter 132 and by a burner flame 134. Basically, when igniter 132 is sufficiently heated to ignite gas, the radiant heat emitted by igniter 132 causes the bimetallic movable arm 122 to move such that contact 126 breaks contact with fixed contact 128. When flame 134 exists, igniter 132 is impinged by flame 134, causing igniter 132 to glow even though, as will be hereafter described, it is de-energized when contacts 126 and 128 open. The resultant radiant heat emitted by igniter 132 and flame 134 causes movable arm 122 to remain in the position wherein contacts 126 and 128 are open. When igniter 132 is not sufficiently heated, or when flame 134 is absent for a sufficiently long time period, movable arm 122 is in the position wherein contacts 126 and 128 are closed.

Terminals 136, 138, 140 and 142 of control module 22 are connected to a gas valve indicated generally at 144. Gas valve 144 includes two normally-closed valves 146 and 148 connected fluidically in series in a gas conduit 150 leading from a gas source (not shown) to a burner 152. A valve winding 154 controls valve 146, and a valve winding 156 controls valve 148. Both valves 146 and 148 must be open to enable gas to flow to burner 152 so as to establish burner flame 134.

Valve winding 154 is connected at one end to terminal 140 of control module 22 and at its other end to terminal 142. Valve winding 156 is connected in a full-wave bridge circuit 158 comprising controlled rectifiers CR1–CR4. A junction 160 of bridge circuit 158 is connected through a resistor R1 to terminal 136 of control module 22. Junction 160 is also connected by a lead 162 to terminal 138 of control module 22. A junction 164 of bridge circuit 158 is connected to terminal 142 of control module 22. Terminal 142 is connected by a lead 166 and lead 88 to terminal 86.

One end of igniter 132 is connected to a terminal 168 of control module 22. The other end of igniter 132 is connected to a terminal 170. Terminal 168 is connected to lead 38 through a set of normally-open relay contacts K4A and relay contacts K1A. Relay contacts K4A are controlled by a relay coil K4. Terminal 170 is connected by a lead 172 to lead 40.

A time-delay circuit 174 is connected by a lead 176 and lead 82 to terminal 80, and by a lead 178 and leads 166 and 88 to terminal 86. Relay coil K3 is connected to circuit 174 by a lead 180. The base of an NPN transistor Q1 is connected by a lead 182 to circuit 174. The collector of transistor Q1 is connected to relay coil K3, and the emitter thereof is connected by a lead 184 and leads 166 and 88 to terminal 86. A controlled rectifier CR5 is connected across relay coil K3 to suppress any back EMF generated by relay coil K3, thereby protecting transistor Q1 from any high voltage or high current due to such EMF generation. As previously described, relay coil K3 controls relay contacts K3A. As will be described in more detail hereinafter, time-delay circuit 174 is effective for providing desired time-delays in energizing and de-energizing relay coil K3.

A relay coil K5 is connected in a full-wave bridge circuit 186 comprising controlled rectifiers CR6–CR9. A junction 188 of bridge circuit 186 is connected by a lead 190 and lead 64 to terminal 62. A junction 192 of bridge circuit 186 is connected by a lead 194, a lead 196 and lead 88 to terminal 86. Relay coil K5 controls a set of normally-closed contacts K5A and a set of normally-open contacts K5B. One side of relay contacts K5A is connected through lead 82 to terminal 80; the other side is connected through relay coil K2 and leads 196 and 88 to terminal 86, and to one side of relay contacts K5B. The other side of relay contacts K5B is connected to terminal 96.

Relay coil K2 is connected in a full-wave bridge circuit 198 comprising controlled rectifiers CR10–CR13. As previously described, relay coil K2 controls relay contacts K2A and K2B.

Relay coil K1 and a relay coil K6 are connected in parallel with each other in a full-wave bridge circuit 200 comprising controlled rectifiers CR14–CR17. As previously described, relay coil K1 controls relay contacts K1A. Relay coil K6 controls a set of normally-open contacts K6A. A junction 202 of bridge circuit 200 is connected by leads 196 and 88 to terminal 86. A junction 204 of bridge circuit 200 is connected through a lead 206 to terminal 112. Junction 204 is also connected through relay contacts K6A and lead 100 to terminal 98.

Relay coil K4 and a relay coil K7 are connected in parallel with each other in a full-wave bridge circuit 208 comprising controlled rectifiers CR18–CR21. As previously described, relay coil K4 controls relay contacts K4A. Relay coil K7 controls a set of normally-closed contacts K7A and a set of normally-open contacts K7B. A junction 210 of bridge circuit 208 is connected through leads 196 and 88 to terminal 86. A junction 212 of bridge circuit 210 is connected through a lead 214 to terminal 130.

A common junction 216 of relay contacts K7A and K7B is connected by a lead 218 and lead 120 to terminal 116. Junction 216 is also connected by leads 218, 120 and a lead 220 to terminal 136. Relay contacts K7B are connected between junction 216 and terminal 138. Relay contacts K7A are connected between junction 216 and time-delay circuit 174 by a lead 222. Relay contacts K7A are also connected by a lead 224 to terminal 140.

Thermostat 12 is illustrated as having switches 226, 228 and 230 connected between terminal R and terminals Y, G and W, respectively. It is to be understood that thermostat 12 can take many forms and that switches 226, 228 and 230 can be mechanical or electronic. Thermostat 12 includes a sensor (not shown) responsive to room temperature. Thermostat 12 also includes means (not shown) for selecting a heating mode, a cooling mode, and continuous or automatic operation of fan 50. Basically, when in the heating mode, switch 230 cycles on and off to maintain the desired heating set point temperature. When in the cooling mode, switch 226 cycles on and off to maintain the desired cooling set point temperature. When continuous operation of fan 50 is selected, switch 228 is constantly closed. When automatic operation of fan 50 is selected, and with the cooling mode selected, switch 228 is closed whenever switch 226 is closed. When automatic operation of fan 50 is selected, and with the heating mode selected, switch 228 remains open. There are some prior art thermostats which also include the capability of being programmed to provide for closing of switch 228, regardless of whether switches 226 and/or 230 are open or closed, during specific time periods of a programmed time-temperature schedule. Typical of a thermostat embodying the above described features is the thermostat shown in U.S. Pat. No. 4,898,229. For purposes of describing the present invention, reference hereinafter to continuous fan operation should be considered as comprising the condition wherein continuous fan operation is selected by providing for switch 228 to be constantly closed and/or the condition wherein continuous fan operation is selected by providing for switch 228 to be closed during specific time periods.

OPERATION

When electrical power is applied to terminals 24 and 26, transformer T1 is energized. With transformer T1 energized, electrical power is provided to time-delay circuit 174, the circuit being: from one side of secondary winding 84 to terminal 80, through leads 82 and 176, circuit 174, leads 178, 166 and 88, and terminal 86 to the other side of secondary winding 84. When so energized, circuit 174 establishes therein unidirectional power sources which will eventually be utilized for turning on transistor Q1 and for effecting energizing of relay coil K3.

With high-limit switch 72 and rollout switch 66 in their normal closed condition, relay coil K5 is energized, the circuit being: from one side of secondary winding 84 to terminal 80, through leads 82 and 78, movable arm 74 and closed contacts 76 and 70 in high-limit switch 72, closed element 68 in rollout switch 66, terminal 62, leads 64 and 190, bridge circuit 186 and relay coil K5, leads 194, 196 and 88, and terminal 86 to the other side of secondary winding 84. With relay coil K5 energized, its normally-closed contacts K5A open and its normally-open contacts K5B close. With relay contacts K5A open and relay contacts K5B closed, relay coil K2 is energizable only through closed relay contacts K5B. Thus, when relay coil K5 is energized, relay coil K2 is de-energized so long as switch 228 in thermostat 12 is open.

When there is a demand for heating, switch 230 in thermostat 12 closes. When switch 230 closes, relay coils K1 and K6 are energized, the circuit being: from one side of secondary winding 84 through closed high-limit switch 72 and closed rollout switch 66 to terminal 62 as previously described, lead 64, terminal 60, lead 14, terminal R, closed switch 230, terminal W, lead 20, terminal 98, lead 100, terminal 102, closed contacts 104 and 110 and movable arm 108 of pressure switch 106, terminal 112, lead 206, bridge circuit 200 and relay coils K1 and K6, leads 196 and 88, and terminal 86 to the other side of secondary winding 84. With relay coil K1 energized, its normally-open contacts K1A close. With relay contacts K1A closed, inducer 42 is energized, the circuit being: from terminal 24 to lead 38, closed relay contacts K1A, terminal 44, inducer 42, terminal 46, and leads 48 and 40 to terminal 26. With relay coil K6 energized, its normally-open contacts K6A close. Closed relay contacts K6A establish a hold-in circuit, in parallel with contacts 104 and 110 in pressure switch 106, for relay coils K1 and K6.

When inducer 42 provides sufficient fluid flow, pressure switch 106 responds to such flow by opening its contacts 104 and 110 and closing its contacts 110 and 114. When this switch action occurs, relay coils K1 and K6 remain energized through lead 100 and closed relay contacts K6A.

When contacts 110 and 114 in pressure switch 106 close, relay coils K4 and K7 are energized, the circuit being: from one side of secondary winding 84 to terminal 98 as previously described, lead 100, closed relay contacts K6A, lead 206, terminal 112, movable arm 108 and closed contacts 110 and 114 in pressure switch 106, terminal 116, lead 120, terminal 118, movable arm 122 and closed contacts 126 and 128 in radiant heat sensing switch 124, terminal 130, lead 214, bridge circuit 208 and relay coils K4 and K7, leads 196 and 88, and terminal 86 to the other side of secondary winding 84.

With relay coil K4 energized, its normally-open contacts K4A close. With relay contacts K4A closed, igniter 132 is energized, the circuit being: from terminal 24 to lead 38, closed relay contacts K1A, closed relay contacts K4A, terminal 168, igniter 132, terminal 170, and leads 172 and 40 to terminal 26.

With relay coil K7 energized, its normally-closed contacts K7A open and its normally-open contacts K7B close. With relay contacts K7A open, current is prevented from flowing to valve winding 154 and to time-delay circuit 174. With relay contacts K7B closed, valve winding 156 is energized, the circuit being: from one side of secondary winding 84 to terminal 116 as previously described, leads 120 and 218, closed relay contacts K7B, terminal 138, lead 162, bridge circuit 158 and valve winding 156, terminal 142, leads 166 and 88, and terminal 86 to the other side of secondary winding 84. Under this condition, valve winding 156 is sufficiently energized to effect opening of valve 148. However, while valve 148 is open, gas cannot flow to burner 152 since valve 146 remains closed due to its valve winding 154 being de-energized.

After a few seconds of being energized, igniter 132 begins to emit a glow due to its being heated. The temperature of igniter 132 and the intensity of such glow increases as igniter 132 continues to be energized. After a sufficiently long time period of energizing of igniter 132, for example, approximately 30 seconds, the radiant heat emitted by the glowing igniter 132 causes the bimetallic arm 122 of radiant heat sensing switch 124 to move such that the normally-closed contacts 126 and 128 therein open. Switch 124 is so constructed and so positioned with respect to igniter 132 that when such switch action is effected, the temperature of igniter 132 is at a value above a minimum temperature at which ignition can occur.

When contacts 126 and 128 in switch 124 open, the electrical circuit to relay coils K4 and K7 is opened whereby relay coils K4 and K7 are de-energized. With relay coil K4 de-energized, its closed contacts K4A open, thereby de-energizing igniter 132. With relay coil K7 de-energized, its open contacts K7A close and its closed contacts K7B open.

With relay contacts K7B open, valve winding 156 remains energized, the circuit being through leads 120 and 220, terminal 136 and resistor R1. Due to resistor R1, the current flow through valve winding 156 is reduced so that the level of energizing of valve winding 156 is less than that which existed when relay contacts K7B were closed. While such a reduced level of energizing is insufficient to effect initial opening of valve 148 from a closed position, it is sufficient to hold in valve 148, that is to say, keep valve 148 open once it is open.

With relay contacts K7A closed, valve winding 154 is energized, the circuit being: from one side of secondary winding 84 to terminal 116 as previously described, leads 120 and 218, closed relay contacts K7A, lead 224, terminal 140, valve winding 154, terminal 142, leads 166 and 88, and terminal 86 to the other side of secondary winding 84. With valve winding 154 energized, it effects opening of valve 146.

With both valves 146 and 148 open, gas flows to burner 152 and is ignited by igniter 132. It is noted that although igniter 132 is de-energized, its mass is sufficient to enable it to maintain, for a short time period after being de-energized, a temperature sufficiently high to ignite gas. Radiant heat sensing switch 124 is responsive to the radiant heat emitted by burner flame 134 and by the glow of igniter 132, such glow being due to the impingement of igniter 132 by flame 134, so as to cause its open contacts 126 and 128 to remain open.

With relay contacts K7A closed, a circuit is completed through closed relay contacts K7A and lead 222 to time-delay circuit 174, causing an internal timing means in circuit 174 to be activated. After approximately 30 seconds, such internal timing means times out, causing a signal to be applied through lead 182 to turn on transistor Q1. When transistor Q1 is turned on, relay coil K3 is energized, the circuit being: from one side of secondary winding to terminal 80, leads 82 and 176, a unidirectional power source in circuit 174, lead 180, relay coil K3, turned-on transistor Q1, leads 184, 166 and 88, and terminal 86 to the other side of secondary winding 84.

With relay coil K3 energized, its normally-open contacts K3A close. With relay contacts K3A closed, a low speed winding of fan 50 is energized, the circuit being: from terminal 24, lead 38, closed relay contacts K2A, closed relay contacts K3A, terminal 54, the low speed winding of fan 50, terminal 56, and leads 58 and 40 to terminal 26. With fan 50 energized, it distributes the air from the furnace plenum, which air has been heated by burner flame 134, throughout the dwelling.

When the demand for heating is satisfied, switch 230 in thermostat 12 opens. With switch 230 open, electrical power is no longer provided to terminal 98 whereby valve windings 154 and 156 are de-energized, causing valves 146 and 148, respectively, to close and thus terminate the flow of gas to burner 152. Also, relay coils K1 and K6 are de-energized. With relay coil K1 de-energized, its closed contacts K1A open thereby de-energizing inducer 42. When the fluid flow effected by inducer 42 ceases, pressure switch 106 reverts back to the position wherein contacts 104 and 110 are made.

Also occurring when electrical power is no longer provided to terminal 98 is the termination of the circuit through lead 222 to time-delay circuit 174. When such circuit is terminated, an internal timing means in circuit 174 is activated. After approximately 60 seconds, such internal timing means times out, causing the previously existing signal on lead 182 to terminate thereby turning off transistor Q1. With transistor Q1 off, relay coil K3 is de-energized. With relay coil K3 de-energized, its contacts K3A open thereby de-energizing fan 50.

After flame has been absent for approximately 20 seconds, bimetallic arm 122 in radiant heat sensing switch 124 moves to the position wherein its contacts 126 and 128 are closed.

When there is a demand for cooling, switches 226 and 228 in thermostat 12 close. With switch 226 closed, contactor coil 92 is energized, the circuit being: from one side of secondary winding 84 to terminal R as previously described, switch 226, terminal Y, lead 16, terminal 94, contactor coil 92, terminal 90, lead 88, and terminal 86 to the other side of secondary winding 84. With contactor coil 92 energized, it closes its contacts to turn on a compressor (not shown). Concurrently, relay coil K2 is energized, the circuit being: from one side of secondary winding 84 to terminal R as previously described, switch 228, terminal G, lead 18, terminal 96, closed relay contacts K5B, bridge circuit 198 and relay coil K2, leads 196 and 88, and terminal 86 to the other side of secondary winding 84. With relay coil K2 energized, its normally-closed contacts K2A open and its normally open contacts K2B close. With relay contacts K2B closed, a high speed winding of fan 50 is energized, the circuit being: from terminal 24, lead 38, closed relay contacts K2B, terminal 52, the high speed winding of fan 50, terminal 56, and leads 58 and 40 to terminal 26. With fan 50 energized, it distributes air from the furnace plenum, which air has been cooled by an evaporator coil therein (not shown), throughout the dwelling.

When continuous operation of fan 50 is desired, switch 228 in thermostat 12 is closed. With switch 228 closed, relay coil K2 is energized through closed relay contacts K5B in the same manner as previously described when switch 228 is closed in conjunction with a demand for cooling, whereby fan 50 runs at high speed. Thus, whenever switch 228 is closed, either due to a demand for continuous fan operation or a demand for cooling, and when relay contacts K5B are closed, fan 50 runs at high speed. It is noted that the arrangement of relay contacts K2A and K2B ensures that both windings of fan 50 cannot be energized at the same time.

While it is preferred that fan 50 be a two-speed fan, it should be noted that a single-speed fan could alternatively be utilized. With a single-speed fan, terminals 52 and 54 would be connected together and the single-speed fan would be connected between terminal 56 and either one of terminals 52 or 54. It should be apparent that with such an arrangement, the single-speed fan would be energized through relay contacts K2B whenever relay coil K2 is energized, and through relay contacts K2A and K3A whenever relay coil K3 is energized and relay coil K2 is de-energized. Furthermore, since there would no longer be two windings in the fan, there would be no need to ensure that two windings cannot be energized at the same time. Therefore, relay contacts K2A could be omitted, thus connecting relay contacts K3A directly to lead 38.

The control system of the present invention provides for safe operation of apparatus 10 in the event of various abnormal occurrences and/or various component failures. For example, if contacts 70 and 76 in high-limit switch 72 open or element 68 in rollout switch 66 opens while switch 230 in thermostat 12 is closed, valve windings 154 and 156 are de-energized to effect closing of gas valves 146 and 148, respectively. Also, regardless of when high-limit switch 72 or rollout switch 66 so functions, relay coil K5 is de-energized. With relay coil K5 de-energized, its normally-closed contacts K5A close and its normally-open contacts K5B open. With relay contacts K5A closed, relay coil K2 is energized, the circuit being: from one side of secondary winding 84, terminal 80, lead 82, closed relay contacts K5A, bridge circuit 198 and relay coil K2, leads 196 and 88, and terminal 86 to the other side of secondary winding 84. With relay coil K2 energized, the high speed winding of fan 50 is energized through closed relay contacts K2B. Fan 50 removes the heat from the furnace plenum, thus protecting the furnace components from damage that might otherwise occur due to high temperature. Since fan 50 is running at high speed, such removal of heat is accomplished more quickly than if fan 50 were at low speed.

It is necessary, both for providing a desired air-gas mixture and for preventing an accumulation of unburned fuel in the combustion chamber, that inducer 42 be running whenever gas is flowing to burner 152. The combination of pressure switch 106, and relay coil K6 and its contacts K6A ensures such operation. Specifically, because relay contacts K6A are normally open, pressure switch contacts 104 and 110 must be connected at the beginning of a normal cycle of operation in order to effect, through lead 206, initial energizing of relay coils K1 and K6. If contacts 104 and 110 are initially connected, inducer 42 is energized through relay contacts K1A, and a hold-in circuit is established for relay coils K1 and K6 through contacts K6A. Valve windings 154 and 156, which control gas valves 146 and 148, respectively, can be eventually energized only if contacts 110 and 114 in pressure switch 106 close and only if relay contacts K6A are closed. Therefore, if pressure switch contacts 104 and 110 are not connected at the beginning of a normal cycle of operation, relay coil K6 cannot be energized whereby normally-open relay contacts K6A prevent valve windings 154 and 156 from being energized. If pressure switch contacts 104 and 110 are initially connected so as to effect initial energizing of relay coils K1 and K6 but contacts 104 and 110 fail to open, then valve windings 154 and 156 cannot be energized since energizing thereof requires that pressure switch contacts 110 and 114 be closed. Such failure of contacts 104 and 110 to open would indicate either that inducer 42 is not providing the required fluid flow or that contacts 104 and 110 are welded together. A failure of contacts 104 and 110 to be connected at the beginning of a normal cycle would indicate either that relay contacts K1A are inadvertently closed or welded together whereby inducer 42 is energized, or that contacts 110 and 114 are welded together.

The combination of relay coil K7 and its contacts K7A and K7B and the hold-in circuit for valve winding 156 ensure safe operation in the event that contacts 126 and 128 in radiant heat sensing switch 124 are open at the initiation of a demand for heating or if, for any other reason, such as a disconnected lead to or from switch 124, electrical power is not provided to terminal 130. Under such a condition, relay coil K7 is de-energized, whereby its normally-closed contacts K7A are closed and its normally-open contacts K7B are open. When power is applied to terminal 116, valve winding 154 is energized to open valve 146. However, valve winding 156, due to insufficient energizing through resistor R1, does not effect opening of valve 148. Therefore, until contacts 126 and 128 close, gas flow to burner 152 is prevented. With relay contacts K7A closed, time-delay circuit 174 is activated whereby, approximately 30 seconds after power appears at terminal 116, transistor Q1 is turned on and relay coil K3 is energized. With relay coil K3 energized, its contacts K3A close, thus energizing fan 50. Since the air being circulated is not heated air, the homeowner would soon become aware that a malfunction has occurred.

It is also noted that should contacts 126 and 128 in switch 124 fail to open, relay coil K7 is energized whereby valve winding 156 is sufficiently energized through closed relay contacts K7B to effect opening of valve 148, but valve winding 154 cannot be energized due to open relay contacts K7A whereby valve 146 remains closed.

If during an otherwise normal burner cycle, ignition does not occur when contacts 126 and 128 in radiant heat sensing switch 124 open, contacts 126 and 128 close, due to the termination of energizing of igniter 132, in approximately 30 seconds. When contacts 126 and 128 close, relay coils K4 and K7 are again energized. As previously described, relay coil K4 effects closure of normally-open relay contacts K4A so as to energize igniter 132, and relay coil K7 controls its contacts K7A and K7B to effect opening of valve 148 but to prevent, until contacts 126 and 128 of switch 124 open, opening of valve 146. It is noted that during the approximately 30-second time period in which fuel is flowing to burner 152, inducer 42 is running whereby the unburned fuel is safely exhausted through the flue. It should be noted that if igniter 132 is properly located with respect to burner 152 and radiant heat sensing switch 124, such failure to ignite is extremely unlikely.

If burner flame 134 is prematurely extinguished for any reason, such as a momentary interruption of the gas source, the resumption of the gas source would cause gas to resume flow to burner 152 until contacts 126 and 128 in radiant heat sensing switch 124 close. Specifically, as previously described, approximately 20 seconds after flame 134 is extinguished, contacts 126 and 128 close, causing relay coils K4 and K7 to be energized. As previously described, relay coil K4 effects closure of its normally-open contacts K4A so as to enable igniter 132 to be energized. Relay coil K7 effects opening of its normally-closed contacts K7A so as to effect de-energizing of valve winding 154 whereby valve 146 closes so as to terminate the flow of gas to burner 152. It is noted that during the approximately 20-second time period in which fuel is flowing to burner 152, inducer 42 is running whereby the unburned fuel is safely exhausted through the flue. When igniter 132 is sufficiently heated, it effects opening of contacts 126 and 128 in switch 124. Burner flame 134 is again established and a normal cycle is continued in the manner previously described.

If a momentary electrical power interruption occurs during a normal cycle, valve windings 154 and 156 are de-energized whereby gas valves 146 and 148 close. Since the power interruption also effected de-energizing of relay coil K6, relay contacts K6A are open. Therefore, when electrical power resumes, electrical power cannot be provided to terminal 116 until contacts 104 and 110 in pressure switch 106 are connected. When contacts 104 and 110 are connected, relay coil K6 is energized, causing its normally-open contacts K6A to close. Relay coil K1 is also energized, causing its normally-open contacts K1A to close, thus causing inducer 42 to be energized. When contacts 110 and 114 in pressure switch 106 close in response to the fluid flow effected by inducer 42, power is provided to terminal 116. Power cannot be provided to relay coils K4 and K7 until contacts 126 and 128 in radiant heat sensing switch 124 close. It is noted that when contacts 126 and 128 are open, valve winding 156 is not sufficiently energized, due to resistor R1, to effect opening of valve 148. When contacts 126 and 128 close, a normal cycle is continued in the manner previously described.

While the invention has been illustrated and described in detail in the drawing and foregoing description, it will be recognized that many changes and modifications will occur to those skilled in the art. It is therefore intended, by the appended claims, to cover any such changes and modifications as fall within the true spirit and scope of the invention.

We claim:

1. In a control system for a gas fired heating apparatus which includes an inducer, a main burner, two gas valves connected fluidically in series with the main burner and each valve having a controlling electrical winding, and a hot surface igniter for directly igniting gas at the main burner, and which apparatus is adapted to be connected to a thermostat, the improvement comprising:

a radiant heat sensing switch having normally-closed contacts which open in response to the igniter being at a temperature above gas ignition temperature and are maintained open thereafter in response to burner flame;

a single-pole, double-throw pressure switch responsive to fluid flow effected by the inducer, said pressure switch having a first contact position in the absence of said fluid flow and a second contact position in the presence of said fluid flow;

first circuit means including said pressure switch when in said first contact position for effecting energizing of said inducer, for effecting energizing of a hold-in circuit for maintaining said energizing of said inducer independently of said pressure switch, and for preventing energizing of said igniter and the electrical windings of said gas valves; and second circuit means including said hold-in circuit, said pressure switch when in said second contact position, and said radiant heat sensing switch for controlling energizing of said igniter and said electrical windings of said gas valves, said hold-in circuit and said pressure switch when in said second contact position being connected in series.

2. The control system claimed in claim 1 wherein said first circuit means includes relay means for controlling energizing of said inducer and relay means for providing said hold-in circuit.

3. The control system claimed in claim 1 wherein said second circuit means includes relay means for controlling energizing of said igniter and relay means for controlling energizing of said electrical windings of said gas valves.

4. The control system claimed in claim 3 wherein said relay means for controlling energizing of said electrical windings includes a relay coil and normally-open and normally-closed contacts; and wherein energizing of said relay coil is controlled by said radiant heat sensing switch in such a manner so that said electrical windings are energized to cause both said gas valves to be open only when said normally-closed contacts in said radiant heat sensing switch are open.

5. The control system claimed in claim 4 wherein said electrical winding of one of said gas valves is energized through said normally-closed relay contacts, when closed, to effect opening of said one of said gas valves; and wherein said electrical winding of the other one of said gas valves is sufficiently energized through said normally-open relay contacts, when closed, to effect opening of said other one of said gas valves, and is sufficiently energized through a resistor, when said normally-open relay contacts are open, to maintain said other one of said gas valves open once it is open but is insufficiently energized through said resistor to effect opening thereof.

6. The control system claimed in claim 1 wherein the apparatus further includes a circulator fan; wherein the control system further includes time-delay circuit means and relay means controlled thereby for effecting energizing of said fan; and wherein said second circuit means includes means for controlling operation of said time-delay circuit means.

7. The control system claimed in claim 6 wherein said apparatus further includes a high-limit switch having normally-closed contacts which open in response to an abnormally high temperature; and wherein said control system further includes relay means responsive to opening of said normally-closed contacts of said high-limit switch for effecting energizing of said fan.

8. The control system claimed in claim 7 wherein said fan is a two-speed fan; wherein said relay means controlled by said time-delay circuit means effects energizing of said fan at a relatively low speed; and wherein said relay means responsive to said opening of said normally-closed contacts of said high-limit switch effects operation of said fan at a relatively high speed.

9. The control system claimed in claim 7 wherein said apparatus further includes a rollout switch connected in series with said high-limit switch and having a normally-closed element which opens in response to impingement by a flame; and wherein said relay means responsive to opening of said normally-closed contacts of said high-limit switch for effecting energizing of said fan is also responsive to opening of said normally-closed element of said rollout switch for effecting energizing of said fan.

10. The control system claimed in claim 6 wherein the thermostat includes switch means for effecting a demand for operation of said fan; and wherein said control system further includes relay means for effecting energizing of said fan in response to said demand and independently of said time-delay circuit means.

11. The control system claimed in claim 10 wherein said fan is a two-speed fan; wherein said relay means controlled by said time-delay circuit means effects energizing of said fan at a relatively low speed; and wherein said relay means responsive to said demand by said thermostat for operation of said fan effects operation of said fan at a relatively high speed.

* * * * *